United States Patent [19]

Kochey

[11] 4,237,825

[45] Dec. 9, 1980

[54] FURNACE HEAT ABSORPTION CONTROL

[75] Inventor: Edward L. Kochey, Colebrook, Conn.

[73] Assignee: Combustion Engineering, Inc., Windsor, Conn.

[21] Appl. No.: 958,225

[22] Filed: Nov. 6, 1978

[51] Int. Cl.[3] ..... F22D 7/00

[52] U.S. Cl. ..... 122/406 ST; 122/347; 236/15 BD

[58] Field of Search ..... 122/406 ST, 347; 236/15 E, 15 BD

[56] References Cited

U.S. PATENT DOCUMENTS

| | | | |
|---|---|---|---|
| 3,117,556 | 1/1964 | Bowlus | 122/406 ST |
| 3,187,727 | 6/1965 | Ravese | 122/406 ST |
| 3,189,006 | 6/1965 | Kochey, Jr. | 122/406 ST |
| 3,288,199 | 11/1966 | Gerrard et al. | 236/15 E |
| 3,335,782 | 8/1967 | De Livois | 236/15 BD |
| 3,532,079 | 10/1970 | Chambert | 122/406 ST |
| 3,607,117 | 9/1971 | Shaw | 236/15 BD |
| 3,723,047 | 3/1973 | De Livois | 236/15 E |
| 3,789,806 | 2/1974 | Gorzegno | 122/406 ST |
| 3,838,015 | 9/1974 | Buchbinder et al. | 432/72 |

*Primary Examiner*—Henry C. Yuen

*Attorney, Agent, or Firm*—Edward L. Kochey, Jr.

[57] ABSTRACT

Furnace performance is controlled during start-up or very low load operation at a time when the minimum air flow required to be supplied to the furnace is significantly greater than that required to burn the fuel being supplied to the furnace. Decreased furnace heat absorption is accomplished by supplying a larger quantity of the air immediately adjacent the fuel input location for the purpose of diluting the combustion gases and immediately decreasing their temperature level. Increased furnace heat absorption is obtained by introducing a greater portion of the air flow into the furnace at a location remote from the fuel being burned so that the gases at the fuel location remain at a high temperature, and transfer heat to the walls, before being diluted by the incoming air.

2 Claims, 2 Drawing Figures

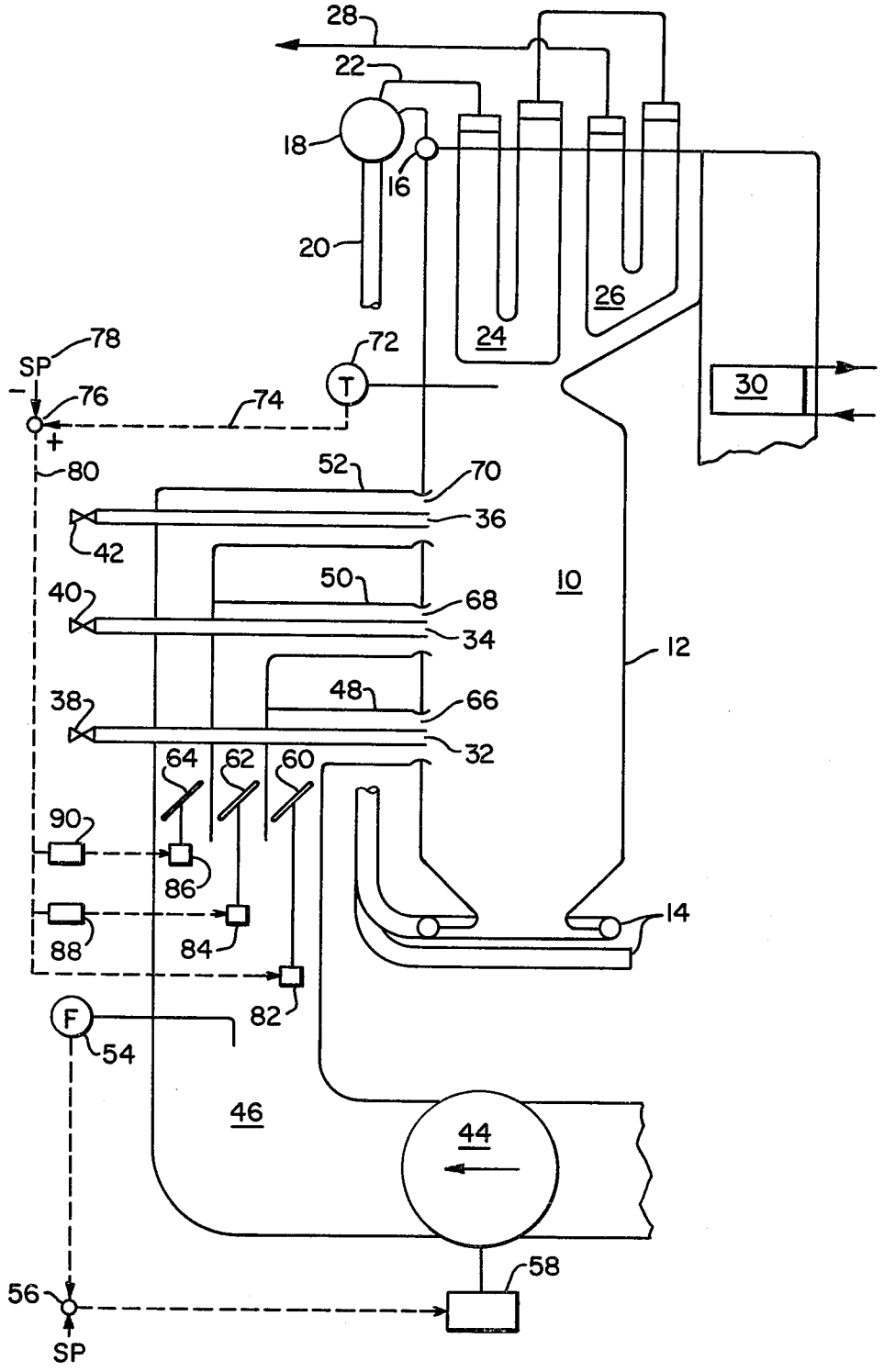
28
22
18
16
20
24
26
30
78
SP
76
74
72
T
80
52
70
36
42
50
10
40
68
34
12
48
66
38
32
64
62
60
90
86
88
84
14
82
F
54
46
44
58
56
SP

FURNACE HEAT ABSORPTION CONTROL

BACKGROUND OF THE INVENTION

The invention relates to operation of fossil fuel steam generators during start-up and at extremely low ratings, and in particular to control of heat absorption.

In a drum-type steam generating unit with superheat surface a total amount of heat absorption is required to heat the feed water to saturation temperature, to boil the water, and to superheat it to a desired level. Not only is there a requirement that the total heat absorption be supplied to the steam generator but the ratio of heat absorbed in the evaporative plus economizer surface to that absorbed in the superheater must be controlled. At high load operation various control methods have been successfully used including steam de-superheating, gas recirculation, and furnace burner tilt.

The same problem applies to reheat units whether of the drum-type or once-thru type, and it also applies to once-thru units with respect to superheat when the water wall outlet temperature is controlled for purposes of either limiting it to a safe value or for controlling the rate of temperature change during a start-up.

During start-up operation of a steam generator a minimum air flow in the order of 25 to 30 percent of the full load air flow is maintained through the steam generating unit. This air flow is introduced in the furnace to minimize the probability of a fuel rich flame failure due to insufficient oxygen in the furnace. With this high excess air, the gas side control methods used at higher loads are marginally effective and the superheating spraying is not effective at these low loads due to the lack of turbulence and evaporation of the spray at the extremely low steam flows occurring.

SUMMARY OF THE INVENTION

During start-up and very low load operation of a fossil fuel steam generating unit, a minimum air flow in the order of 25 to 30 percent of full load air flow is passed through the furnace. Fuel is injected at a location and burned in that area. The air flow is regulated so that a desired portion of the air flow enters adjacent the fuel with the remainder of the air flow entering the furnace remote from the fuel. Furnace heat absorption for a given fuel input is decreased by introducing additional air immediately adjacent the fuel being burned so that the air immediately mixes with the combustion gases decreasing their temperature by dilution. When increased furnace heat absorption is required, the ratio of air is adjusted so that more of it is introduced remote from the flame and accordingly the flame temperature tends to approach its stoichiometric level. The high temperature existing at that time produces substantial heat transfer to the walls prior to dilution with the air which is introduced remotely from the fuel.

Since the area of concern is the relative heat absorption between the furnace walls and the superheater, a measure of the superheat temperature would be an appropriate measure of the furnace performance in view of what was desired. However, the extremely long response time required to obtain a result at the low boiler ratings makes direct control based on superheat temperature a poor parameter to use. A faster response can be obtained by using the furnace outlet gas temperature and regulating the location of air into the furnace in response to the furnace outlet temperature. The desired furnace outlet temperature may be reset as a function of the superheater outlet temperature if desired.

BRIEF DESCRIPTION OF THE DRAWINGS

The FIGURE illustrates a schematic arrangement of a steam generator embodying the control and regulating aspects of the invention.

DETAILED DESCRIPTION OF THE INVENTION

The steam generator includes a furnace 10 having the walls lined with steam generating tubes 12 which convey water from the lower water wall inlet headers 14 to an upper header 16 and then to steam drum 18. Downcomer 20 provides for recirculation of the water to the furnace while steam connecting tubes 22 convey the steam to a primary superheater 24 and a secondary superheater 26. From this location the steam is passed out through steam line 28 to a point of use not shown. An economizer 30 preheats the incoming feed water before it is supplied to steam drum 18.

The furnace includes fuel injection at several locations indicated as 32, 34, and 36. Fuel to each of these fuel injection ports is controlled by a means schematically indicated as valves 38, 40, and 42, respectively. The fuel may be oil or pulverized coal with the control of pulverized coal being by means of feeder speed regulation. In any event the fuel is injected into the furnace for suspension burning therein.

During start-up fuel is introduced through fuel injection nozzle 32 in an amount required for the heat up rate desired. Air is supplied by forced draft fan 44 passing through fan discharge duct 46 through air duct 48, 50, and 52, each of which is associated with a corresponding fuel injection port. The total air flow quantity is measured by air flow meter 54 with the measured air flow being compared to a set point air flow at set point 56, and with a control signal thereafter passing to a fan speed controller 58. This controls the total air flow, and during start-up and very low load operation it is controlled to maintain a quantity of air equal to 30 percent of the rated full load boiler air flow. Control dampers 60, 62, and 64 are operative to vary the ratio of the supplied air passing through the air ducts 48, 50, and 52 and thence through the air supply means 66, 68, and 70, respectively.

Heat transfer in a furnace is primarily by radiation with convection playing a very small part in the heat transfer. The amount of heat transferred by radiation is a function of the difference of the fourth power of the absolute temperatures of the radiating source and heat sink. At high load operation in a steam generator where the furnace exit gas temperature is in the order of 2200° F. and the wall temperature in the order of 600° F. there is substantial heat transfer.

During start-up and low load operation the temperature of the walls may vary from normal room temperature to about 600° or 700° F. while the furnace outlet temperatures vary from a few hundred degrees to about 1000° F. The lower furnace outlet temperatures tend to exist at the same time that the lower water wall temperatures exist. If for instance a water wall temperature of about 300° F. is being used with a gas temperature of 400° to 500° F., the difference in the fourth power of these absolute temperatures is relatively insignificant. It follows that very little heat is transferred from the mixed gases leaving the furnace.

The gases in the furnace are cooled by dilution with the excess air and by radiation of heat to the walls of the furnace. An immediate dilution of the gases produced by the burning fuel with the excess air available drops the temperature of these gases before heat can be transferred to the water walls, and the lower temperature achieved by this dilution is ineffective in transferring heat to the walls. On the other hand, if mixing of the combustion gases with the excess air is delayed, there is time for heat to be transferred to the walls from the relatively high temperature of the gases. It is this phenomenon which is utilized to obtain the furnace heat absorption control of this invention.

It is pointed out that during this discussion the fuel quantity supplies to the furnace is maintained constant. The total heat absorption to the steam generator is not changed but is relocated between furnace wall absorption and superheater absorption. Since a known quantity of heat in the form of fuel and preheated air is placed into the furnace, this heat must either remain in the gases as they leave the furnace or be transferred to the furnace walls. Accordingly a measure of the gas temperature leaving the furnace is indicative of the amount of heat transferred to the furnace walls. Other parameters which could be used to measure the effectiveness of the furnace heat absorption would include measurements of the superheater steam temperature. During start-up operation this may be ineffective, particularly before steam flow starts. During low load operation it is ineffective because of the low velocities of steam and high thermal inertia of the pressure parts as compared to the low steam flow. Accordingly, if it is desired that the superheater outlet temperature be used as the parameter to be controlled, it is recommended that this parameter be regulated by adjusting the furnace gas outlet temperature set point so as to permit a tight control loop around the furnace outlet temperature.

Accordingly, a temperature sensor 72 is located to measure the temperature of gases leaving the furnace. This emits a control signal indicative of the measured furnace outlet temperature through control line 74 to comparison point 76. A set point 78 indicative of the desired furnace wall outlet temperature is compared to this signal, with an error signal passing through control line 80 indicative of a temperature error between the desired and actual. This control signal passes through controllers 82, 84, and 86 which are operatively connected to dampers 60, 62, and 64 for the regulation of air through the corresponding ducts.

With fuel being burned in the lower burner 32, signal inverters 88 and 90 are used in the other two controllers. Accordingly, a control signal which moves damper 60 in one direction would move damper 62 and 64 in the opposite direction. If desired, damper 62 may be manually locked in a fixed position so that the control operates to vary the ratio of air flow between ducts 48 and 52.

As illustrated, the air introduced remote from the fuel is introduced at a location in the furnace above the fuel. This is the ideal arrangement since it minimizes the mixing of the remotely introduced air with the combustion gases. The invention is, however, operative with the fuel being introduced at a location above the remote introduction of air with some decrease in its efficacy because of mixing of the air as it passes upwardly through the furnace.

What is claimed is:

1. A fossil fuel-fired steam generator adapted for start-up and very low load temperature control comprising: a furnace; steam generator tubes lining the walls of said furnace; a gas exit duct for conveying gases from said furnace; superheat surface located in said exit duct; means for conveying steam generated in said steam generating tubes to said superheat surface; firing means for injecting suspended fuel into said furnace; a first air means for introducing air into said furnace adjacent said firing means; a second air means for introducing air into said furnace remote from said firing means; means for establishing a total air flow to said furnace of a constant quantity; means for adjusting the ratio of air through said first and second air means; means for measuring a parameter of the heat absorption of the tubes lining the walls of said furnace; and said means for adjusting the ratio of air responsive to said means for measuring a parameter, means for establishing a desired heat absorption of the tubes lining the walls of said furnace; means for comparing said means for measuring a parameter to said means for establishing a desired heat absorption and establishing a signal indicative of insufficient or excess furnace heat absorption; means for increasing the ratio of air through said first means with respect to said second means in response to a signal indicating excess furnace heat absorption; and decreasing said ratio in response to a signal indicating an insufficiency of said heat absorption.

2. An apparatus as in claim 1: wherein said means for measuring a parameter comprises means for measuring the temperature of gases leaving the furnace.

* * * * *